United States Patent [19]

Dubowicz

[11] Patent Number: 4,536,768

[45] Date of Patent: Aug. 20, 1985

[54] COAXIAL POWER DISSIPATION LINE

[75] Inventor: Palemon W. Dubowicz, Eatontown, N.J.

[73] Assignee: The United States of America as represented by the Secretary of the Army, Washington, D.C.

[21] Appl. No.: 489,993

[22] Filed: Apr. 29, 1983

[51] Int. Cl.[3] ..... H01Q 11/06

[52] U.S. Cl. ..... 343/736; 343/739

[58] Field of Search ..... 343/731-740, 343/809, 905, 860-862; 333/22 R, 22 F, 236

[56] References Cited

U.S. PATENT DOCUMENTS 2,208,810 7/1940 Katzin ..... 343/736

FOREIGN PATENT DOCUMENTS 1275391 5/1972 United Kingdom ..... 343/739

OTHER PUBLICATIONS

Jasik, "Antenna Engineering Handbook," McGraw Hill, N.Y., 1961, pp. 4-10 to 4-15, and pp. 4-33 to 4-35.

"The ARRL Antenna Book", published by the American Radio Relay League, Newington, Ct., 14th edition, 1983, pp. 3-18 to 3-22, 7-7 to 7-10.

Basic Communications Text CC210-11-12, National Radio Institute, Wash., D.C. 1976, pp. 210-30 to 210-32, 211-1 to 211-15, 211-24, 25.

*Primary Examiner*—Eli Lieberman

*Assistant Examiner*—Michael C. Wimer

*Attorney, Agent, or Firm*—Anthony T. Lane; Jeremiah G. Murray; Robert A. Maikis

[57] ABSTRACT

A termination for a VHF inverted-V half-rhombic antenna is described, consisting of a transformer terminated into a length of high attenuation coaxial cable acting as a power dissipation line.

6 Claims, 6 Drawing Figures

COAXIAL POWER DISSIPATION LINE

The invention described herein may be manufactured, used, and licensed by or for the Government for Governmental purposes without the payment of any royalties thereon.

FIELD OF THE INVENTION

This invention relates to VHF inverted-V antennas and, more particularly, to a termination for a half-rhombic directional antenna used for ground-to-ground communications.

BACKGROUND OF THE INVENTION

As is known and understood, inverted-V half-rhombic antennas have been considered for use in ground-to-ground communications systems because of their tactical directional antenna capability in the VHF range. In usage where a five port multicoupler is employed in conjunction with five radio equipments, each operating at a different frequency, as much as 200–400 watts of RF power is fed into the antenna input. Under such conditions, approximately half the power has to be dissipated in the antenna termination—and, typically, non-inductive, lumped resistors have been employed. Oil bath arrangements, however, were usually needed for such combinations, in order to dissipate the large amounts of heat generated in their 100–200 watt lumped resistor terminations. The overall termination package (encasing the oil and the resistor) for such high wattage conditions tended to be quite large, fairly heavy (in the order of 10 lbs. and more), cumbersome and quite expensive. At the same time, such power dissipating resistors exhibited a tendency to be somewhat fragile and, mechanically, of limited strength.

Such characteristics led to a restricted use of these highly directional antennas in tactical ground-to-ground communications systems.

SUMMARY OF THE INVENTION

As will be seen from the description below, the termination of the present invention includes a transformer terminated into a length of high attenuation coaxial transmmission line cable acting as a power dissipation line. The termination transformer is selected to step-down the characteristic impedance of the inverted-V antenna to match the termination coaxial cable impedance, and the coaxial cable operated open-ended in a length required to obtain sufficient attenuation and to dissipate the heat generated. As will be described a high attenuation coaxial cable can be employed, being laid under the antenna, itself, and extending from the terminating end in a direction towards the antenna input, with the coaxial cable shield being used as a ground return. Experimentation has shown that with a coaxial power dissipation line of this type, of between 125–175 feet in length, the antenna VSWR can be maintained at less than 2:1 over a frequency range of 30 to 88 MHz, and with a gain greater than 3 db as compared with a reference dipole antenna. At the same time, the cost of the coaxial line and the added matching transformer were determined to be many times less than the cost of the previously employed lumped resistor termination arrangements.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
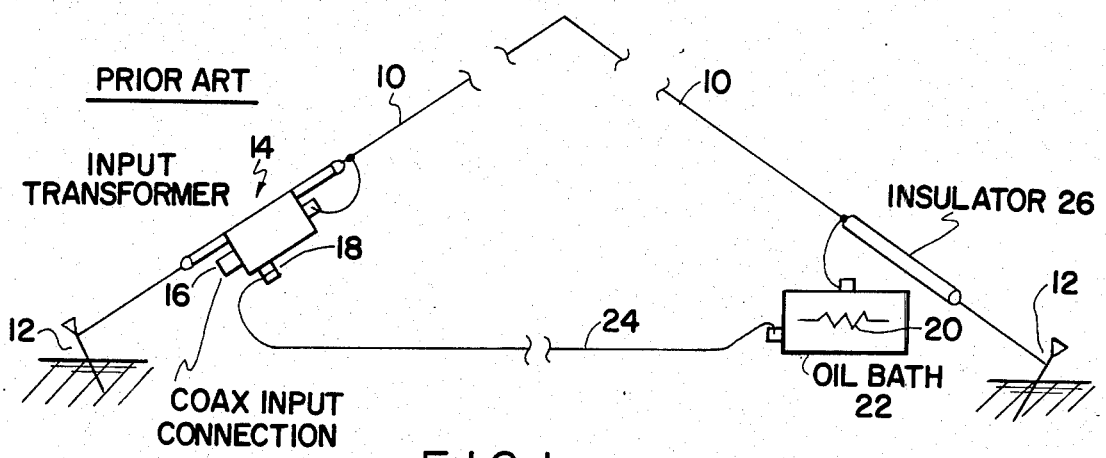
FIG. 1 illustrates a resistor termination for a VHF inverted-V antenna as is employed in the prior art.

In FIG. 1, reference numeral 10 represents the mast-supported antenna wire, which is staked to the ground, as at 12. An input transformer 14 of suitable construction is shown, to provide the required impedance ratio between the coaxial input connection (at 16) with the characteristic impedance of the inverted-V antenna, in accordance with the height of the mast support, the length of the ground wire return and the lengths of the antenna wires at the frequency ranges envisioned. For a 50 ohms unbalanced feed cable, for example, a 1:9 impedance ratio may be typical for a VHF frequency range, the ground lug being shown as 18. In prior art constructions, a resistor termination 20 is typically employed, 450 ohms and of 100–200 watts rating, encased in a surrounding oil bath 22. The ground wire return for the antenna construction is shown at 24, with reference notation 26 identifying the insulator employed.

As was previously described, were such an inverted-V antenna operated in conjunction with either two port multicouplers, or five port multicouplers, each operating with radio sets of different frequency, the input power requirements might be such that the power needed to be dissipated in the resistor termination 20 would mandate an oil bath package which would be, at the same time, heavy, cumbersome and quite expensive.

Figure 2:
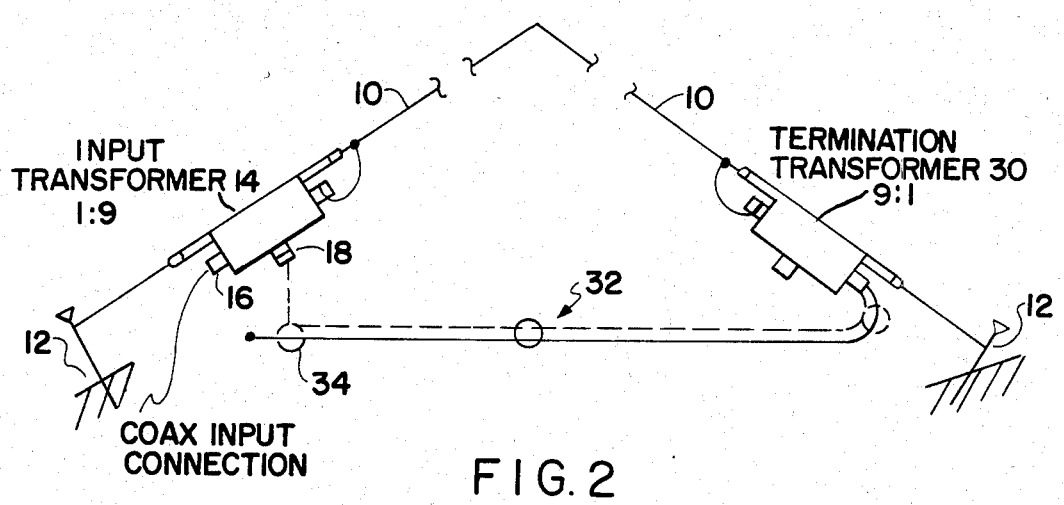
FIG. 2 illustrates the inverted-V antenna with the coaxial power dissipation line embodying the present invention.

In accordance with the teachings of the present invention, on the other hand, a termination transformer 30 and a coaxial cable 32 are substituted for the resistor termination 20, oil bath 22 and insulator 26 of the FIG. 1 arrangement. More specifically, and as shown in FIG. 2, the termination transformer is selected of 9:1 impedance ratio, to step the high impedance down to 50 ohms unbalanced, with the coaxial line 32 being laid under the antenna back towards its input, and with its shield 34 being used as the ground return. Although illustrated as being open-circuited, experimentation has indicated that the antenna VSWR stayed within a 2:1 range over the entire VHF frequency band whether the coaxial line 32 was short-circuited or open-circuited at its end. Further experimentation also indicated that with the coaxial line used for termination in this manner, gains of greater than 3 db were had as compared to a reference dipole antenna. (In such preferred embodiment, a RG-174 coaxial cable was employed, with a coaxial connector of BNC type designations.)

Figure 3:
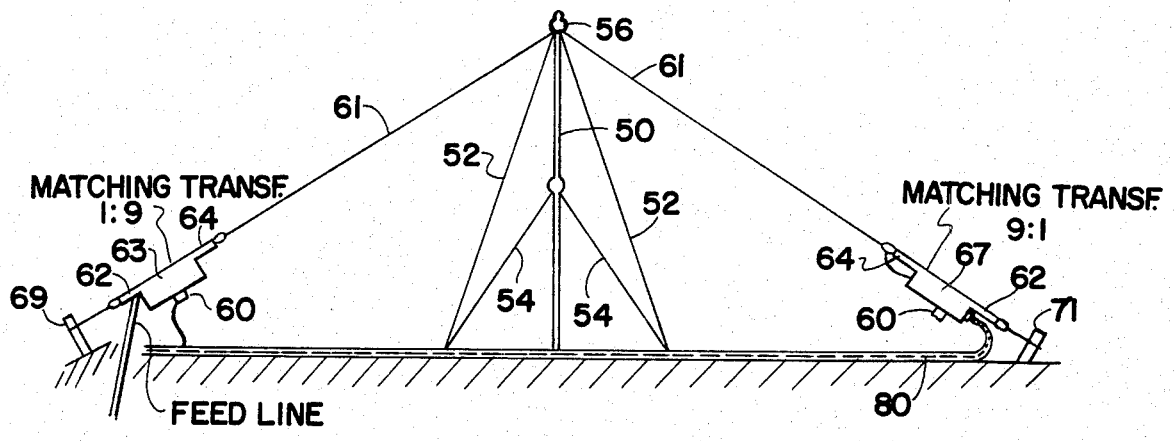
FIGS. 3–5 show various construction features helpful in an understanding of the manner by which an inverted-V antenna can be erected for use, according to the invention.
Figure 4:
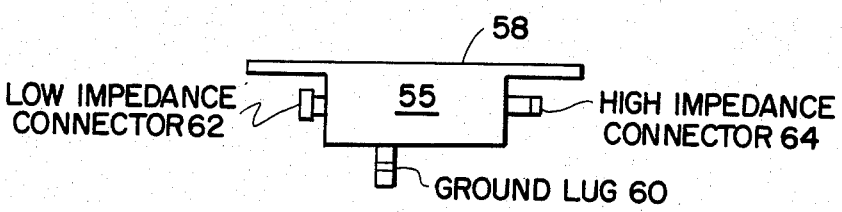
Figure 5:
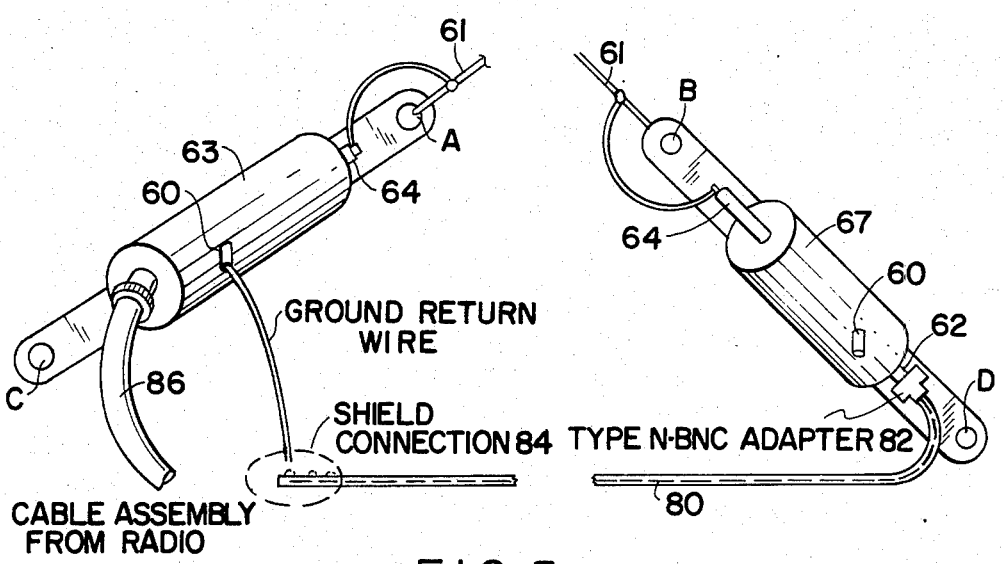

The first step in erecting the VHF inverted-V antenna according to the invention (FIGS. 3–5) is to select a site free from obstruction to an extent of 165 feet in the direction of the remote communications station with an unobstructed height of 30 feet at the center of the site location, and with an approximately 33 foot radius area cleared at the center for the erection of the mast 50 and guy wires 52, 54. The support mast 50 is then assembled with its base at the center of the 165 foot direction, and left lying on the ground at right angles thereto. An insulator mast cap 56 is installed at the top-most section of the mast 50, as shown.

Each impedance matching transformer 55 includes a case 58 (which acts as an insulator) and is provided with a ground lug 60, a low impedance connector 62 and a high impedance connection 64. The antenna wire 61 is then unwound in the 165 foot direction, with its opposite ends respectively coupled to the high impedance connections 64 of the 1:9 input transformer 63 and of the 9:1 terminating transformer 67, through strain relief points A and B. One stake 69 with guy rope is then driven into the ground at a location farthest away from the remote station (approximately 80 feet from the base of the support mast 50) and the guy rope hooked to point C of the input transformer 63. The center of the antenna wire 61 is then grasped, walked out to the support mast extremity, and placed in the mast insulator at 56, the mast 50 thereafter being raised to the upright position. The antenna wire is then pulled taut, towards the remote station, and a second stake 71 with guy rope is hooked to point D of the termination transformer 67 and then driven into the ground.

With the arrangement as thus far described, the next step in the sequence is to unwind the lossy coaxial transmission line cable 80 (termination and ground return cable approximately 160 feet in length) to be laid centrally beneath the antenna wire in the direction of the remote communications station. At one end, the cable is connected to the low impedance connector 62 of the transformer 67 by a "type N to BNC" adapter 82. The opposite end of the cable 80 is left open circuited, on the other hand, but its shield connection 84 is connected to the ground lug 60 of the input transformer 63. With the ground lug 60 of the terminating transformer 67 left unconnected, and with a matching feed line (of some 50 ohms) coupling the radio assembly to the low impedance connector 62 of the matching transformer 63 (as by 86), the antenna is assembled and ready for operation.

Figure 6:
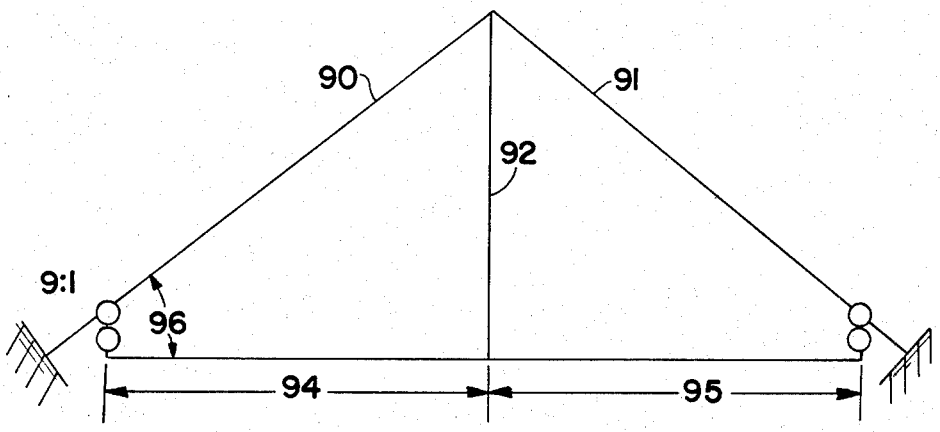
FIG. 6 indicates various dimensions for antenna erection in accordance with a preferred embodiment of the invention.

In one preferred embodiment of the invention, as shown in FIG. 6, each length 90, 91 of the antenna wire 61 was selected to be 2.52 per leg at 30 MHz operating frequency, or approximately 83 feet. The height 92 of the mast 50 was selected to be 30 feet, and the ground wire return lengths 94, 95 were selected approximately 78 feet each. The angle of installation 96 was further selected at approximately 20°.

With the component parts of the preferred embodiment as set forth, an overall construction can be had in which the half-rhombic antenna can be carried about in a satchel type bag for ultimate use. Any desired dismantling of the antenna would then follow in the reverse order of its installation.

While there has been described what is considered to be a preferred embodiment of the present invention, it will be appreciated by those skilled in the art that modifications can be made without departing from the scope of the teachings herein. Thus, whereas the invention has been described in the context of an operating range of 30–88 MHz, it will be appreciated that the advantages which follow can work equally as well at other frequencies—as at higher frequencies, where the length of the ground wire return can, but need not be, shortened, and at lower frequencies, also, a greater length of coaxial line is needed to obtain the required attenuation. For extremely long dissipation lines, the ground return connection can be made to the shield of the coaxial cable anywhere along its length, and this will allow for proper fit under the half-rhombic antenna. The remaining length of cable beyond the ground return connection will act like an additional counterpoise for the antenna and should be spread out on the ground. The coaxial dissipation line provides a counterpoise automatically since the cable is laid on the ground or can be buried if desired.

There are also other possible applications for use of the coaxial power dissipation line; for example, a terminated "V" antenna has two separate non-inductive power resistors and separate counterpoises, one for each leg of the V. Another example is in terminated long wire antennas whicch have a non-inductive power resistor termination and counterpoise. These examples, and almost any radio frequency circuit requiring a nearly non-reactive power termination, can be effectively replaced by a coaxial dissipation line with the proper transformer for impedance matching. For at least the foregoing reasons, therefore, resort should be had to the claims appended hereto for a correct understanding of the scope of the invention.

I claim:

1. Power dissipation termination apparatus for an inverted-V antenna of the type utilizing an impedance matching input transformer at one end of the antenna for signal radiation in ground-to-ground communication systems, comprising:

a coaxial cable having an inner conductor and a surrounding shield;

a termination transformer at the other end of the antenna coupled to match the characteristic impedance of said coaxial cable with the characteristic impedance of said antenna, said termination transformer having the input thereof coupled to said antenna and the output thereof coupled to said inner conductor of said coaxial cable at one end of said cable;

and wherein said cable is physically extended beneath said antenna in a direction from said termination transformer towards said input transformer, and with its said surrounding shield being coupled to a point of electrical ground.

2. The power dissipation termination apparatus of claim 1 wherein said termination transformer is provided with a high impedance input connection electrically coupled to said antenna and with a low impedance output connection coupled to said one end of said coaxial cable, the other end of said cable being in an open circuit condition.

3. The power dissipation termination apparatus of claim 1 wherein said termination transformer is provided with a high impedance input connection electrically coupled to said antenna and with a low impedancce output connection coupled to said one end of said coaxial cable, the other end of said cable being in a short circuit condition.

4. The power dissipation termination apparatus of claim 2 wherein said coaxial cable is selected of a power handling capability to dissipate the power of said antenna over the operative frequency range of said inverted-V antenna.

5. The power dissipation termination apparatus of claim 4 wherein said coaxial cable is selected of sufficient attenuation to reduce the reflected power to a point where the actual impedance is about equal to the characteristic impedance of the coaxial cable in a length of the order of 160 feet for an inverted-V half-rhombic antenna operative over a VHF frequency range.

6. The power dissipation termination apparatus of claim 5 wherein said termination transformer is selected of a 1:9 impedance ratio for use with a 50 ohms dissipation characteristic coaxial cable.

* * * * *